US012606290B2

(12) United States Patent
Saruwatari et al.

(10) Patent No.: US 12,606,290 B2
(45) Date of Patent: Apr. 21, 2026

(54) MARINE PROPULSION DEVICE

(71) Applicant: YAMAHA HATSUDOKI KABUSHIKI KAISHA, Iwata (JP)

(72) Inventors: Kimitaka Saruwatari, Shizuoka (JP); Akihiro Noma, Shizuoka (JP); Masanari Mori, Shizuoka (JP); Yushi Fujita, Shizuoka (JP); Hiroaki Kageyama, Shizuoka (JP); Shinobu Murouchi, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 396 days.

(21) Appl. No.: 18/234,917

(22) Filed: Aug. 17, 2023

(65) Prior Publication Data

US 2024/0116618 A1 Apr. 11, 2024

(30) Foreign Application Priority Data

Oct. 5, 2022 (JP) ..... 2022-161148

(51) Int. Cl.
*B63H 23/06* (2006.01)
*B63H 23/30* (2006.01)

(52) U.S. Cl.
CPC ..... *B63H 23/06* (2013.01); *B63H 23/30* (2013.01)

(58) Field of Classification Search
CPC ..... B63H 23/06; B63H 23/30
See application file for complete search history.

(56) References Cited

U.S. PATENT DOCUMENTS 2,495,169 A * 1/1950 Jennings ..... F42B 19/12 384/275
8,435,090 B1 * 5/2013 Lonnborg ..... B63H 20/002 440/78
2003/0236148 A1 * 12/2003 Fox ..... F16H 57/08 475/348

* cited by examiner

*Primary Examiner* — Stephen P Avila
(74) *Attorney, Agent, or Firm* — Keating & Bennett, LLP

(57) ABSTRACT

A marine propulsion device includes a first gear, a second gear, a third gear, a circulator, a case, and an attachment body. The second gear is meshed with the first gear. The third gear is meshed with the first gear, and the third gear is coaxial with the second gear and opposed to the second gear. The circulator is between the second gear and the third gear. The case includes an internal space in which the first gear, the second gear, the third gear, and the circulator are located. The case includes an attachment hole to which the circulator is attached. The attachment body is inserted into the attachment hole so as to attach the circulator to the case.

7 Claims, 17 Drawing Sheets

MARINE PROPULSION DEVICE

CROSS REFERENCE TO RELATED APPLICATIONS

This application claims the benefit of priority to Japanese Patent Application No. 2022-161148 filed on Oct. 5, 2022. The entire contents of this application are hereby incorporated herein by reference.

BACKGROUND OF THE INVENTION

1. Field of the Invention

The present invention relates to a marine propulsion device.

2. Description of the Related Art

There is a type of marine propulsion device in which the mechanical power of a drive source is transmitted by first and second shafts extending in different directions. The marine propulsion device includes a gear mechanism for switching the direction of rotation transmitted from the first shaft to the second shaft. For example, U.S. Pat. No. 8,435,090 describes an outboard motor that includes a drive shaft, a pinion gear, a front bevel gear, a rear bevel gear, a clutch, and a propeller shaft. The pinion gear is connected to the drive shaft. The front bevel gear and the rear bevel gear are disposed in opposition to each other and are each meshed with the pinion gear. The front bevel gear and the rear bevel gear are coaxial with the propeller shaft and are rotatable with respect thereto. The pinion gear, the front bevel gear, and the rear bevel gear are disposed inside a case filled with lubricating oil.

The clutch switches between engagement and disengagement of the front bevel gear and the propeller shaft and between engagement and disengagement of the rear bevel gear and the propeller shaft. For example, the clutch causes the front bevel gear to be engaged with the propeller shaft while causing the rear bevel gear to be disengaged from the propeller shaft. Accordingly, the rotation of the drive shaft is transmitted to the propeller shaft such that the propeller shaft is rotated in a forward moving direction. On the other hand, the clutch causes the rear bevel gear to be engaged with the propeller shaft while causing the front bevel gear to be disengaged from the propeller shaft. Accordingly, the rotation of the drive shaft is transmitted to the propeller shaft such that the propeller shaft is rotated in a rearward moving direction.

In the outboard motor described above, the front bevel gear and the rear bevel gear are rotated in opposite directions to each other. Because of this, collision occurs between the flow of lubricating oil caused by the rotation of the front bevel gear and that caused by the rear bevel gear such that resistance is generated against the rotation of the front bevel gear and that of the rear bevel gear.

In view of this, U.S. Pat. No. 8,435,090 discloses a configuration in which a circulator is disposed between the front bevel gear and the rear bevel gear so as to inhibit a collision between the flow of lubricating oil caused by the rotation of the front bevel gear and that caused by the rotation of the rear bevel gear.

However, the circulator is required to be disposed in a small space between the front bevel gear and the rear bevel gear. Thus, there is still room for improvement in a method of fixing the circulator.

SUMMARY OF THE INVENTION

Preferred embodiments of the present invention provide improved configurations to fix circulators to cases in marine propulsion devices.

A marine propulsion device according to a preferred embodiment of the present disclosure includes a first gear, a second gear, a third gear, a circulator, a case, and an attachment body. The second gear is meshed with the first gear. The third gear is meshed with the first gear, is coaxial with the second gear, and opposes the second gear. The circulator is between the second gear and the third gear. The case includes an internal space in which the first gear, the second gear, the third gear, and the circulator are located. The case includes an attachment hole to which the circulator is attached. The attachment body is inserted into the attachment hole so as to attach the circulator to the case.

According to the preferred embodiment described above, the case is provided with the attachment hole such that the circulator is able to be attached to the case with the attachment body. Since the case itself is provided with the attachment hole, the circulator is able to be fixed to the case in a limited space between the second gear and the third gear.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
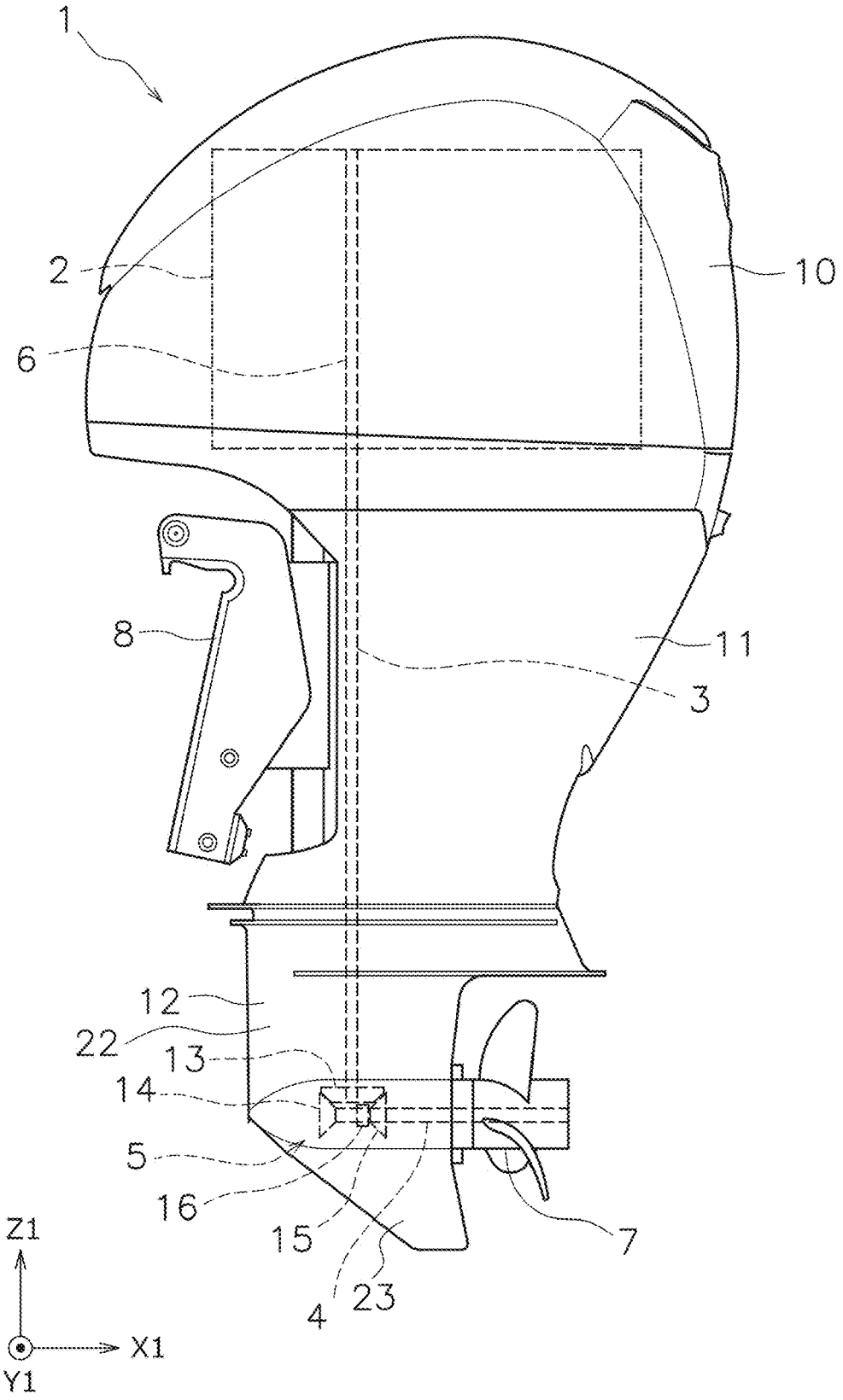
FIG. 1 is a side view of a marine propulsion device according to a first preferred embodiment of the present invention.

A marine propulsion device 1 according to a first preferred embodiment will be explained with reference to the drawings. FIG. 1 is a side view of the marine propulsion device 1 according to the first preferred embodiment. The marine propulsion device 1 according to the present preferred embodiment is an outboard motor. The marine propulsion device 1 is attached to the stern of a watercraft through a bracket 8.

The marine propulsion device 1 includes a drive source 2, a first shaft 3, a second shaft 4, and a shift mechanism 5. The drive source 2 includes, for instance, an internal combustion engine. Alternatively, the drive source 2 may include an electric motor. The first shaft 3 is connected to the drive source 2. The first shaft 3 extends in a first axial direction Z1. In the present preferred embodiment, the first axial direction Z1 refers to the up-and-down direction of the marine propulsion device 1. The drive source 2 includes a crankshaft 6. The crankshaft 6 extends in the first axial direction Z1. The first shaft 3 is connected to the crankshaft 6.

The second shaft 4 extends in a second axial direction X1. The second axial direction X1 intersects with the first axial direction Z1. The second axial direction X1 refers to the back-and-forth direction of the marine propulsion device 1. The second shaft 4 is connected to the first shaft 3 through the shift mechanism 5. A propeller 7 is attached to the second shaft 4. The propeller 7 is rotated by a torque generated by the drive source 2. Accordingly, the propeller 7 generates a thrust to propel the watercraft.

The marine propulsion device 1 includes a cowl 10, a housing 11, and a case 12. The drive source 2 is disposed inside the cowl 10. The housing 11 is disposed directly below the cowl 10. The case 12 is disposed directly below the housing 11. The first shaft 3 extends through the housing 11 and the case 12.

Figure 2:
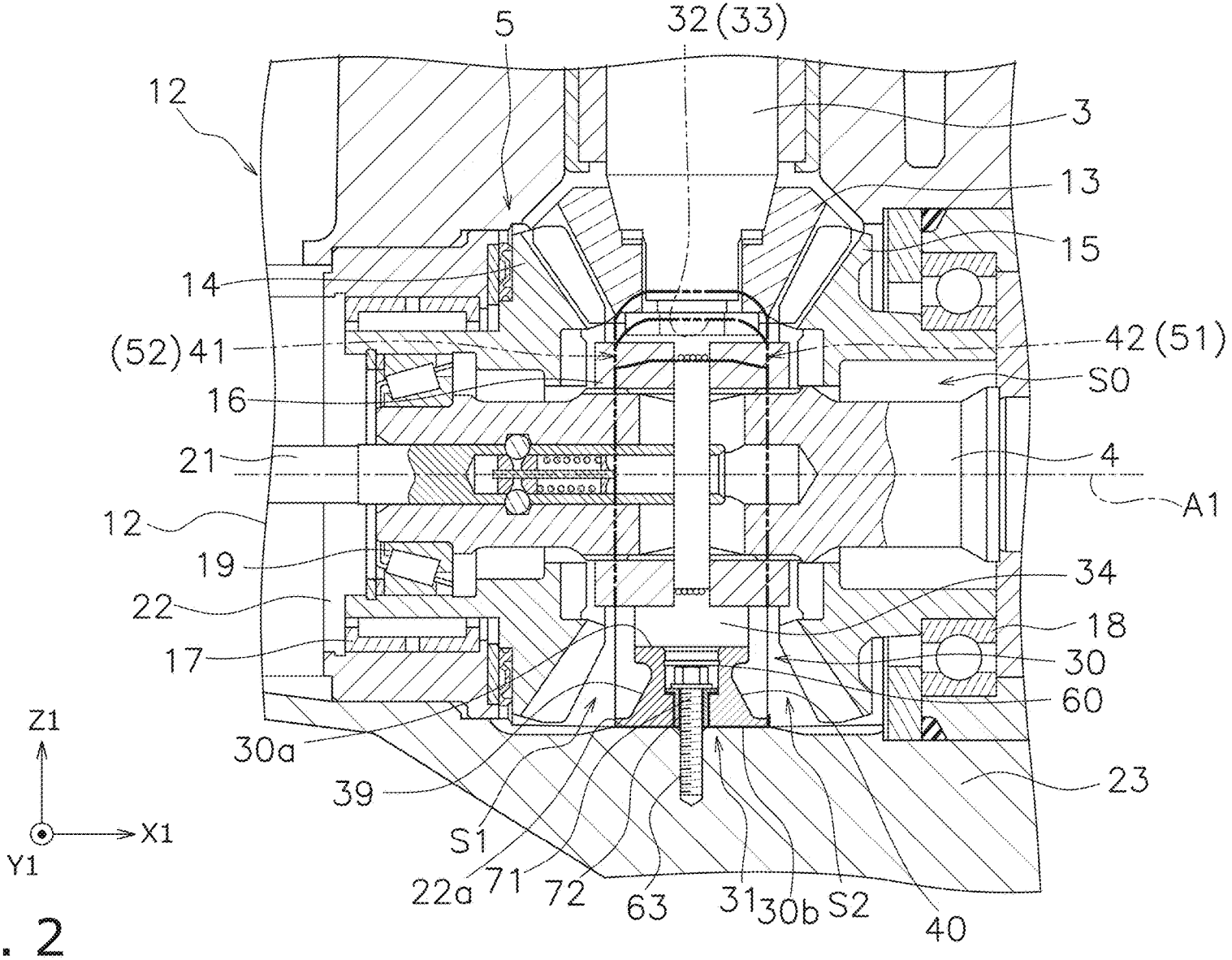
FIG. 2 is a cross-sectional view of a shift mechanism inside a case.

FIG. 2 is a cross-sectional view of the shift mechanism 5 inside the case 12. As shown in FIGS. 1 and 2, the case 12 includes a gear case 22 and a skeg 23. As shown in FIG. 2, the gear case 22 has an internal space S0 in which the shift mechanism 5 is disposed. The skeg 23 extends downward from the gear case 22.

The internal space S0 is filled with lubricating oil. The shift mechanism 5 includes a first gear 13, a second gear 14, a third gear 15, and a clutch mechanism 16. The first gear 13 is connected to the first shaft 3. The first gear 13 is fixed to the lower end of the first shaft 3 and is rotated together with the first shaft 3. The second and third gears 14 and 15 are meshed with the first gear 13. The first to third gears 13 to 15 are, for instance, bevel gears.

The second gear 14 is rotatably supported by the case 12 through a bearing 17. The third gear 15 opposes the second gear 14 in the second axial direction X1. The third gear 15 is rotatably supported by the case 12 through a bearing 18. The third gear 15 is rotated in a reverse direction to the second gear 14. The second shaft 4 extends in the second axial direction X1 so as to extend through the second and third gears 14 and 15. The second and third gears 14 and 15 are coaxial with the second shaft 4. The second shaft 4 is supported by the second gear 14 through a bearing 19. The second and third gears 14 and 15 are rotatable with respect to the second shaft 4.

The clutch mechanism 16 switches between engagement and disengagement of the second gear 14 and the second shaft 4 and between engagement and disengagement of the third gear 15 and the second shaft 4. The clutch mechanism 16 includes, for instance, a dog clutch. However, the clutch mechanism 16 may be a clutch of a different type than the dog clutch. The clutch mechanism 16 is rotated together with the second shaft 4. The clutch mechanism 16 is disposed directly below the first gear 13. The clutch mechanism 16 is disposed between the second and third gears 14 and 15 in the second axial direction X1.

The clutch mechanism 16 is movable in the second axial direction X1. A shift shaft 21 is connected to the clutch mechanism 16. The shift shaft 21 is connected to a shift actuator (not shown in the drawings). The shift shaft 21 is moved in the second axial direction X1 by the shift actuator being electrically controlled. Alternatively, the shift shaft 21 may be connected to a shift rod. The shift shaft 21 may be moved in the second axial direction X1 by the shift rod being manually operated.

More specifically, the clutch mechanism 16 is movable to a neutral position shown in FIG. 2, a first position, and a second position. The clutch mechanism 16 is meshed with the second gear 14 in the first position. When in the first position, the clutch mechanism 16 causes the second gear 14 to be engaged with the second shaft 4 while causing the third gear 15 to be disengaged from the second shaft 4. Accordingly, the rotation of the first gear 13 is transmitted to the second shaft 4 through the second gear 14. The third gear 15 idles with respect to the second shaft 4. As a result, the second gear 14 and the second shaft 4 are rotated in a first rotational direction.

The clutch mechanism 16 is meshed with the third gear 15 in the second position. When in the second position, the clutch mechanism 16 causes the third gear 15 to be engaged with the second shaft 4 while causing the second gear 14 to be disengaged from the second shaft 4. Accordingly, the rotation of the first gear 13 is transmitted to the second shaft 4 through the third gear 15. The second gear 14 idles with respect to the second shaft 4. As a result, the third gear 15 and the second shaft 4 are rotated in a second rotational direction. The second rotational direction is reverse to the first rotational direction.

When in the neutral position, the clutch mechanism 16 is meshed with neither the second gear 14 nor the third gear 15. Therefore, both the second and third gears 14 and 15 idle with respect to the second shaft 4. Because of this, the rotation of the first gear 13 is not transmitted to the second shaft 4. It should be noted that the first rotational direction may refer to a forward moving direction while the second rotational direction may refer to a rearward moving direction. On the other hand, the first rotational direction may refer to the rearward moving direction while the second rotational direction may refer to the forward moving direction.

Figure 3:
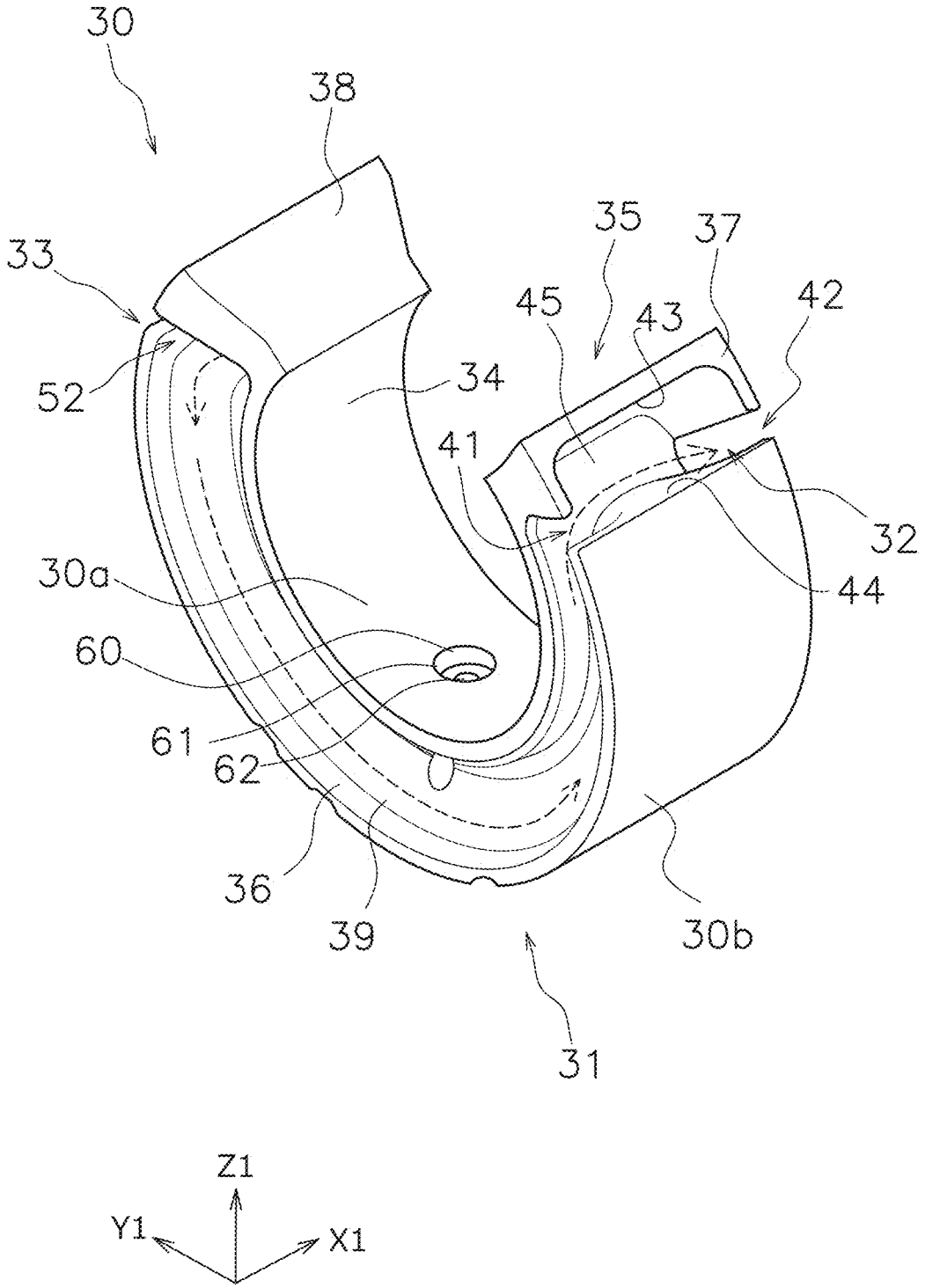
FIG. 3 is a perspective view of a circulator.
Figure 4:
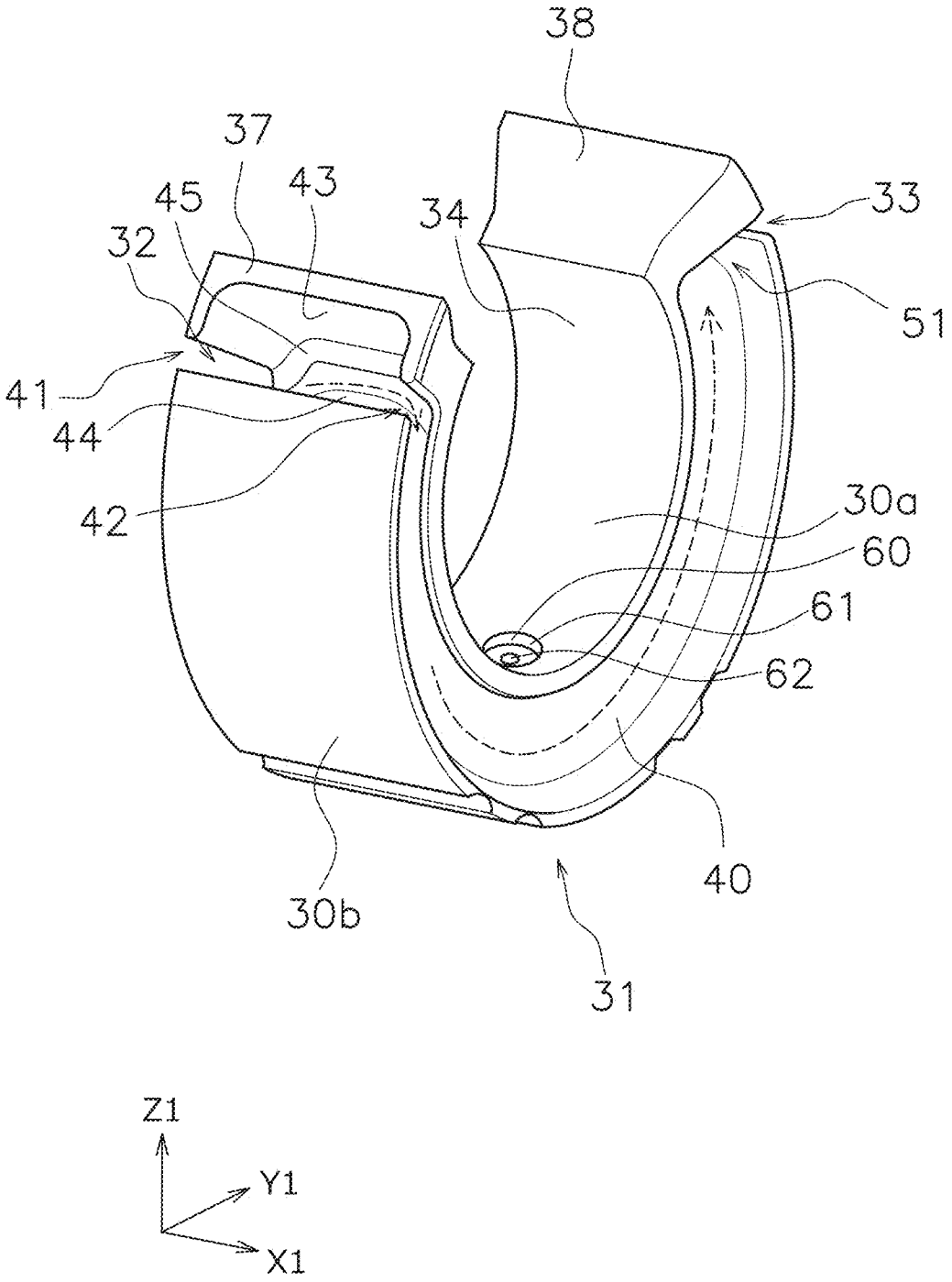
FIG. 4 is a perspective view of the circulator.
Figure 5A:
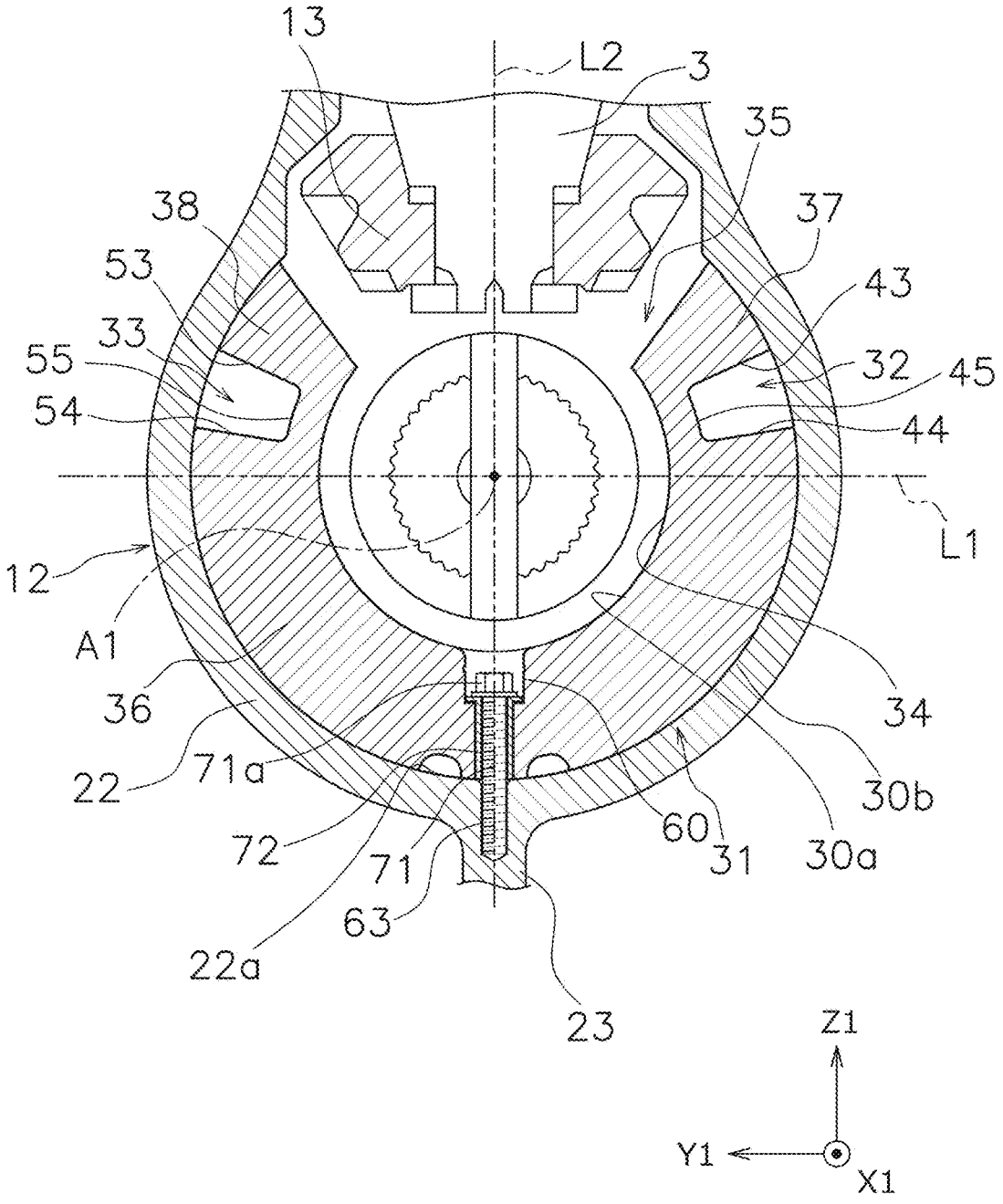
FIG. 5A is a cross-sectional view of an interior of the case as seen in a second axial direction.

The marine propulsion device 1 includes a circulator 30. The circulator 30 is disposed in the internal space S0 of the case 12. The circulator 30 is made of metal, for instance, aluminum. FIGS. 3 and 4 are perspective views of the circulator 30. FIG. 5A is a cross-sectional view of the interior of the case 12 as seen in the second axial direction X1. As shown in FIGS. 3 to 5A, the circulator 30 includes a partition 31, a first channel 32, and a second channel 33.

The partition 31 has a circular-arc contour as seen in the second axial direction X1. The partition 31 is disposed between the second and third gears 14 and 15 in the internal space S0. As shown in FIG. 2, the partition 31 divides the internal space S0 into a first space S1 and a second space S2. The first space S1 is where the second gear 14 is disposed. The second space S2 is where the third gear 15 is disposed.

As shown in FIGS. 3 and 4, the partition 31 includes a middle hole 34, an opening 35, a first wall 36, a second wall 37, and a third wall 38. The middle hole 34 extends through the partition 31 in the second axial direction X1. The clutch mechanism 16 is disposed inside the middle hole 34. The second shaft 4 extends through the middle hole 34. The opening 35 extends radially outward from the middle hole 34. The opening 35 extends in the first axial direction Z1. More specifically, the opening 35 extends upward from the middle hole 34. The first gear 13 is disposed inside the opening 35.

The first to third walls 36 to 38 are disposed radially outside the middle hole 34. The first to third walls 36 to 38 oppose the second and third gears 14 and 15 in the second axial direction X1. The first wall 36 has a circular-arc shape. The first wall 36 has a central angle of greater than 180 degrees. The first wall 36 extends farther upward than the center of the partition 31.

The second wall 37 is disposed between the opening 35 and the first wall 36 in the circumferential direction of the partition 31. The second wall 37 has a circular-arc shape. The second wall 37 has a smaller central angle than the first wall 36. As shown in FIG. 5A, the third wall 38 is disposed on the opposite side of the second wall 37 in a third axial direction Y1. The third axial direction Y1 is perpendicular to the first axial direction Z1 as seen in the second axial direction X1. The third axial direction Y1 refers to the right-and-left direction of the marine propulsion device 1. The third wall 38 is disposed between the opening 35 and the first wall 36 in the circumferential direction of the partition 31. The opening 35 is disposed between the second and third walls 37 and 38. The third wall 38 has a circular-arc shape. The third wall 38 has a smaller central angle than the first wall 36.

As shown in FIG. 3, the first wall 36 includes a first recessed groove 39. The first recessed groove 39 opposes the second gear 14. The first recessed groove 39 is recessed from the surface of the first wall 36 in the second axial direction X1. As shown in FIG. 2, the first recessed groove 39 is has the shape of a curved surface. The first recessed groove 39 extends along the circumferential direction of the first wall 36. The first recessed groove 39 extends along the rotational direction of the second gear 14.

As shown in FIG. 4, the first wall 36 includes a second recessed groove 40. The second recessed groove 40 is disposed on one of the opposite surfaces of the first wall 36 while the first recessed groove 39 is disposed on the other. The second recessed groove 40 opposes the third gear 15. The second recessed groove 40 is recessed from the surface of the first wall 36 in the second axial direction X1. As shown in FIG. 2, the second recessed groove 40 has the shape of a curved surface. The second recessed groove 40 extends along the circumferential direction of the first wall 36. The second recessed groove 40 extends along the rotational direction of the third gear 15.

The first channel 32 penetrates through the circulator 30 in the second axial direction X1. The first channel 32 allows the first and second spaces S1 and S2 to communicate with each other. The first channel 32 is located closer to the first gear 13 than a center line A1 of the second shaft 4 extending in the second axial direction X1. In other words, the first channel 32 is located farther upward than the center line A1 of the second shaft 4. The first channel 32 is disposed between the first and second walls 36 and 37. The first channel 32 is disposed at least in part between the first gear 13 and the center line A1 of the second shaft 4 in the first axial direction Z1.

As shown in FIG. 5A, when seen in the second axial direction X1, the first channel 32 is disposed between the opening 35 and an imaginary line L1 in the circumferential direction of the circulator 30. The imaginary line L1 extends through the center line A1 of the second shaft 4 and in the third axial direction Y1 as seen in the second axial direction X1. As shown in FIGS. 2 to 4, the first channel 32 includes a first inlet 41 and a first outlet 42.

The first inlet 41 communicates with the first space S1. The first inlet 41 opposes the second gear 14 in the second axial direction X1. The first outlet 42 communicates with the second space S2. The first outlet 42 opposes the third gear 15 in the second axial direction X1. As shown in FIG. 3, the first channel 32 includes a first top surface 43, a first bottom surface 44, and a first lateral surface 45. The first top surface 43 has the shape of a curved surface that is recessed upward. The first bottom surface 44 has the shape of a curved surface that bulges upward. The first lateral surface 45 is disposed between the middle hole 34 and the first channel 32.

As seen in the second axial direction X1, the second channel 33 is located on the opposite side of the first channel 32 with reference to an axis of symmetry extending in the first axial direction Z1. The second channel 33 is symmetrical in shape to the first channel 32. The second channel 33 extends through the circulator 30 in the second axial direction X1. The second channel 33 allows the first and second spaces S1 and S2 to communicate with each other. The second channel 33 is located closer to the first gear 13 than the center line A1 of the second shaft 4. In other words, the second channel 33 is located farther upward than the center line A1 of the second shaft 4.

The second channel 33 is disposed between the first and third walls 36 and 38. The second channel 33 is disposed at least in part between the first gear 13 and the center line A1 of the second shaft 4 in the first axial direction Z1. As shown in FIG. 5A, when seen in the second axial direction X1, the second channel 33 is disposed between the opening 35 and the imaginary line L1 in the circumferential direction of the circulator 30.

The second channel 33 includes a second inlet 51 and a second outlet 52. The second inlet 51 communicates with the second space S2. The second inlet 51 opposes the third gear 15 in the second axial direction X1. The second outlet 52 communicates with the first space S1. The second outlet 52 opposes the second gear 14 in the second axial direction X1. As shown in FIG. 5A, the second channel 33 includes a second top surface 53, a second bottom surface 54, and a second lateral surface 55. The second top surface 53 has the shape of a curved surface that is recessed upward. The second bottom surface 54 has the shape of a curved surface that bulges upward. The second lateral surface 55 is disposed between the middle hole 34 and the second channel 33.

The circulator 30 divides the internal space S0 of the case 12, by the partition 31, into the first space S1 where the second gear 14 is disposed and the second space S2 where the third gear 15 is disposed. Accordingly, a collision of lubricating oil is reduced or prevented due to the flow of the lubricating oil caused by the rotation of the second gear 14 and that caused by the rotation of the third gear 15. Because of this, the loss of a drive torque is reduced or prevented. In other words, the efficiency of transmitting the drive torque is enhanced. The circulator 30 is made of metal and thus has enhanced thermal conductivity. Thus, an increase in the temperature of the lubricating oil is reduced or prevented.

As shown in FIG. 5A, the circulator 30 includes an inner peripheral surface 30*a*, an outer peripheral surface 30*b*, and a through hole 60 (an exemplary first through hole). The inner peripheral surface 30*a* defines the middle hole 34 and has a circular-arc shape as seen in the second axial direction X1. The outer peripheral surface 30*b* is disposed outside the inner peripheral surface 30*a* and has a circular-arc shape as seen in the second axial direction X1. The first through hole 60 penetrates through the circulator 30 from the inner peripheral surface 30*a* to the outer peripheral surface 30*b*.

As shown in FIG. 2, the through hole 60 opposes the first shaft 3. The through hole 60 extends downward along the first axial direction Z1 from the inner peripheral surface 30*a* around the middle hole 34 to the outer peripheral surface 30*b*. As shown in FIGS. 3 and 4, the through hole 60 is disposed directly below and opposed to the opening 35. The through hole 60 extends along an imaginary line L2 that extends through the center line A1 and parallel or substantially parallel to the first axial direction Z1.

Figure 5B:
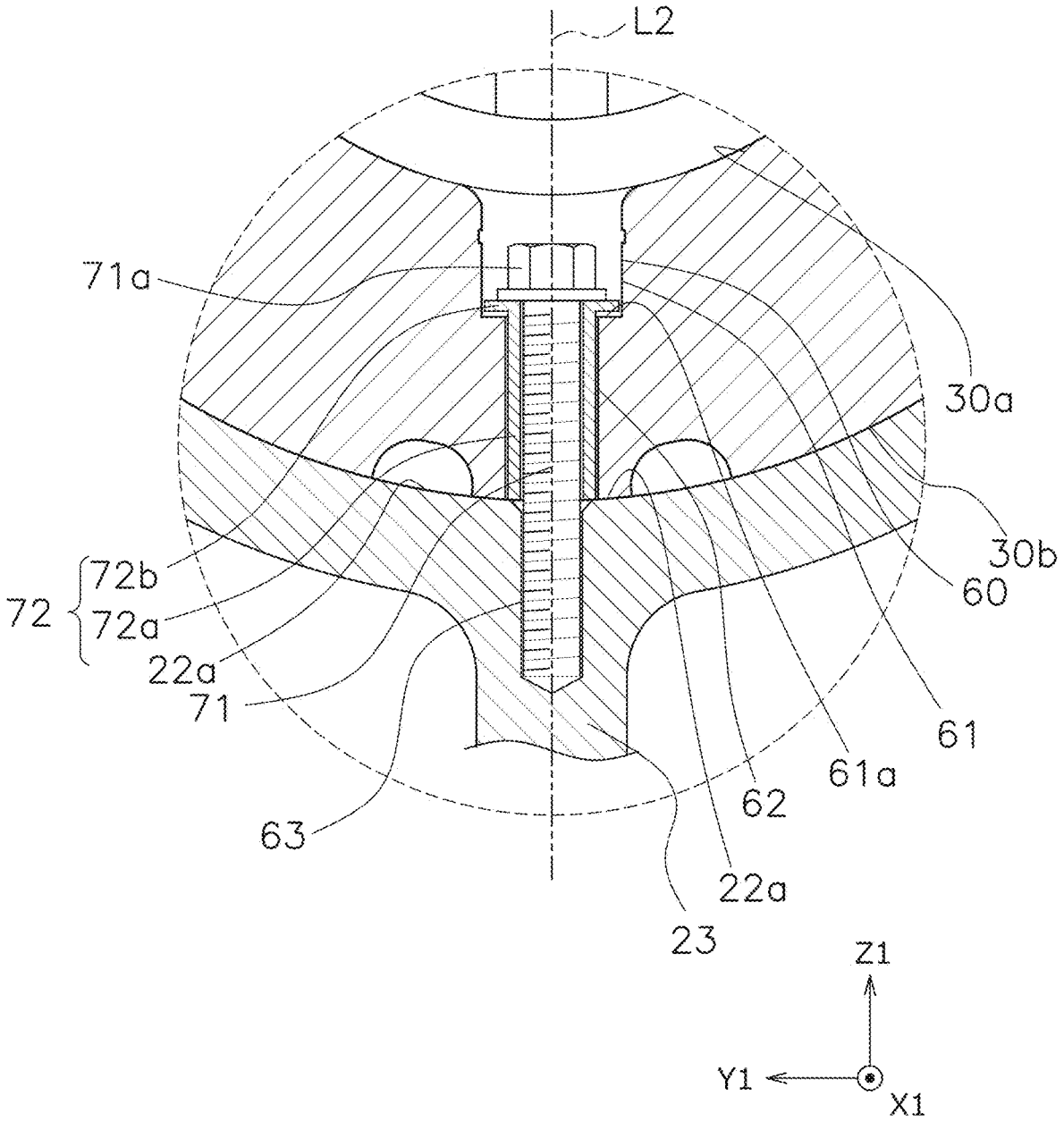
FIG. 5B is a partial enlarged view of FIG. 5A.

FIG. 5B is a partial enlarged view of FIG. 5A. As shown in FIG. 5B, the through hole 60 includes a large diameter portion 61 and a small diameter portion 62. The large diameter portion 61 is provided on a side of the inner peripheral surface 30*a*. As shown in FIG. 5B, the large diameter portion 61 has a columnar shape. The large diameter portion 61 extends from the inner peripheral surface 30*a*. The small diameter portion 62 is continuous with the large diameter portion 61. The small diameter portion 62 extends from a bottom surface 61*a* of the large diameter portion 61 to the outer peripheral surface 30*b*. The small diameter portion 62 has a columnar shape. The small diameter portion 62 is smaller in inner diameter than the large diameter portion 61. The center axis of the small diameter portion 62 and that of the large diameter portion 61 are arranged on the imaginary line L2. The small diameter portion 62 is disposed on the skeg 23 side of the large diameter portion 61.

The case 12 is provided with an attachment hole 63 in which an attachment body, for example a bolt 71, is inserted. As shown in FIGS. 5A and 5B, the attachment hole 63 extends along the imaginary line L2 that extends through the center line A1 and is parallel or substantially parallel to the first axial direction Z1. The attachment hole 63 is perpendicular or substantially perpendicular to the second axial direction X1. A center axis of the attachment hole 63 corresponds to a center axis of the through hole 60. The attachment hole 63 is disposed below a lower side of the second shaft 4. The attachment hole 63 extends from an inner surface 22*a* of the gear case 22 to the skeg 23. The skeg 23 extends downward from the middle of the case 12 in the third axial direction Y1. The attachment hole 63, at least in part, extends into the skeg 23. The attachment hole 63 is provided with female threads on the inner peripheral surface thereof. The attachment hole 63 extends downward into the thickness of the skeg 23.

As shown in FIG. 5B, a collar 72 is disposed inside the through hole 60. As shown in FIG. 5B, the collar 72 includes a tubular portion 72*a* and a flange portion 72*b* disposed on one end of the tubular portion 72*a*. The flange portion 72*b* is disposed in the large diameter portion 61. The tubular portion 72*a* is inserted into the small diameter portion 62. The outer diameter of the tubular portion 72*a* is substantially equal to the inner diameter of the small diameter portion 62. The tubular portion 72*a* contacts with the inner surface 22*a* of the gear case 22. The tubular portion 72*a* is longer than the small diameter portion 62.

As shown in FIG. 5B, the bolt 71 is inserted from the inner peripheral surface 30*a* into the attachment hole 63 through the inner side of the tubular portion 72*a* of the collar 72. The bolt 71 is provided with male threads at least on the distal end thereof, then the male threads are screwed into the female threads on the inner peripheral surface of the attachment hole 63. A head 71*a* of the bolt 71 is accommodated in the large diameter portion 61 without protruding from the inner peripheral surface 30*a*. The head 71*a* of the bolt 71 contacts with the flange portion 72*b* of the collar 72. The bolt 71 fixes the collar 72 to the inner surface 22*a* of the gear case 22. When the circulator 30 is moved in a direction away from the inner surface 22*a* of the gear case 22, the flange portion 72*b* contacts with the bottom surface 61*a* of the circulator 30. The circulator 30 is restricted from moving by the flange portion 72*b* of the collar 72 fixed to the inner surface 22*a* and the inner surface 22*a* of the gear case 22.

Thus, the bolt 71 is inserted into the attachment hole 63 provided in the case 12 through the through hole 60 such that the circulator 30 is fixed between the second gear 14 and the third gear 15 in the interior of the case 12.

Figure 6:
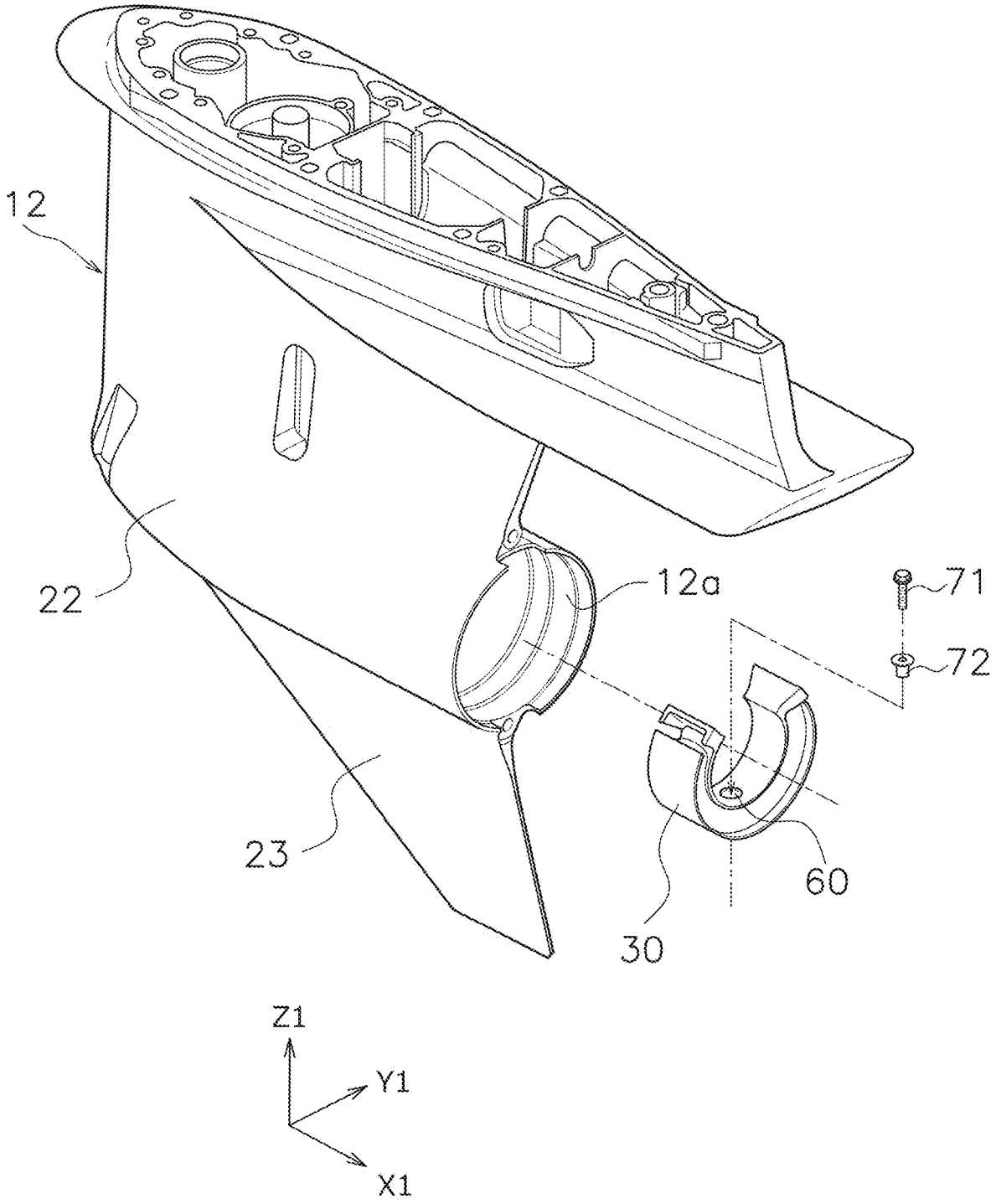
FIG. 6 is a perspective view showing a method of attaching the circulator to the case.
Figure 7:
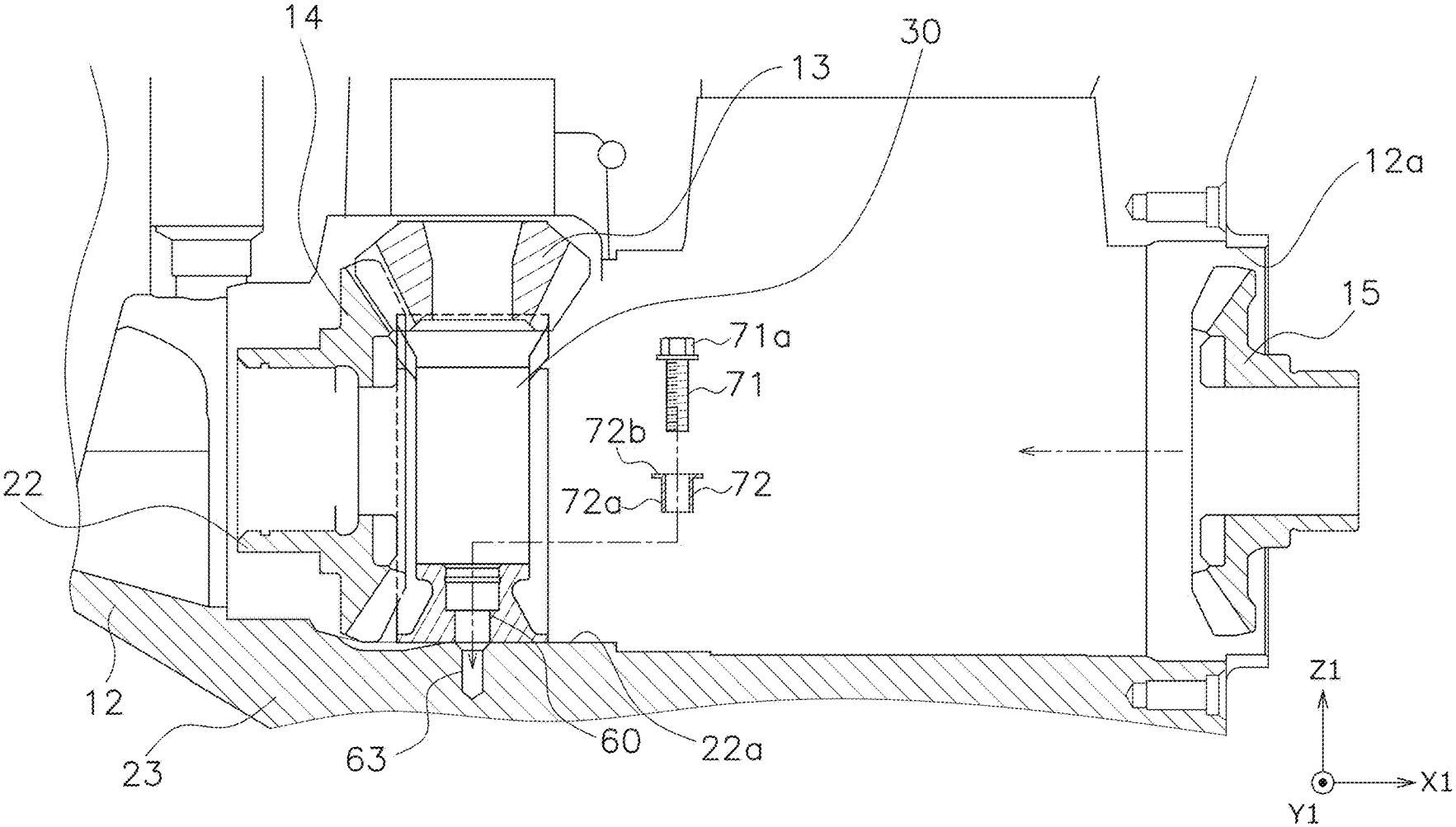
FIG. 7 is a cross-sectional side view showing the method of attaching the circulator to the case.

Next, a method of attaching the circulator 30 to the case 12 will be explained. FIG. 6 is an external view explaining the method of attaching the circulator 30 to the case 12. FIG. 7 is a side view explaining the method of attaching the circulator 30 to the case 12.

As shown in FIG. 6, the circulator 30 is inserted into the case 12 along the second axial direction X1 through an opening 12*a* provided on the propeller 7 side of the case 12. As shown in FIG. 7, when the circulator 30 is inserted into the case 12, the first and second gears 13 and 14 are placed in advance in the gear case 22 of the case 12. In this condition, the circulator 30 is slid along the second axial direction X1 so as to be inserted into the case 12 through the opening 12*a*. The circulator 30 is set in place such that the through hole 60 thereof opposes the attachment hole 63.

Next, the collar 72 is inserted into the case 12, then, as shown in FIGS. 5B and 7, the collar 72 is inserted into the through hole 60. Next, the bolt 71 is inserted into the case 12, then the bolt 71 is inserted into the collar 72 disposed in the through hole 60 (see the arrow in FIG. 7).

Figure 8:
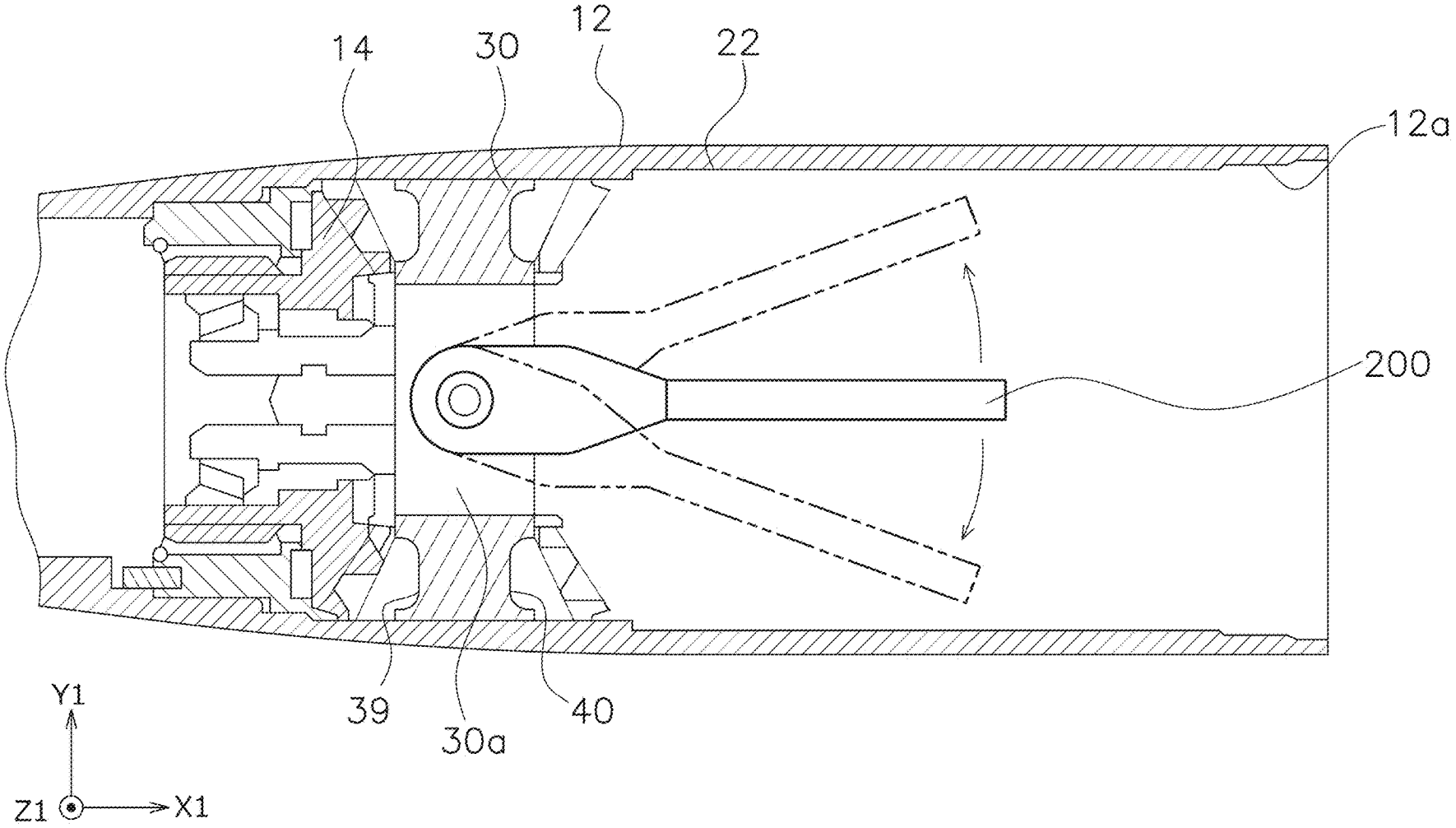
FIG. 8 is a cross-sectional plan view showing the method of attaching the circulator to the case.

FIG. 8 is a configuration diagram of the interior of the case 12 as seen along the first axial direction Z1. FIG. 8 shows a wrench 200. As shown in FIG. 8, a fastening tool such as the wrench 200 is inserted into the case 12 through the opening 12*a*, then the bolt 71 is tightened by the wrench 200 so as to be inserted and screwed into the attachment hole 63.

Next, the clutch mechanism 16 and the third gear 15 are inserted into the case 12, then the second shaft 4 is inserted into the case 12 so as to be inserted into the second and third gears 14 and 15. FIG. 7 shows the third gear 15 to be inserted into the case 12 through the opening 12*a*.

As explained above, the circulator 30 is inserted into the case 12 through the opening 12*a* provided on the propeller 7 side of the case 12 and fixed thereto such that the circulator 30 is easily fixed to the case 12. The circulator 30 is fastened to the case 12 by the bolt 71 such that it is possible to enhance both the assembly and the disassembly of the circulator 30 with respect to the case 12.

Next, a marine propulsion device according to the second preferred embodiment of the present disclosure will be explained. The marine propulsion device in the second preferred embodiment is different in the configuration of a circulator from that in the first preferred embodiment.

Figure 9A:
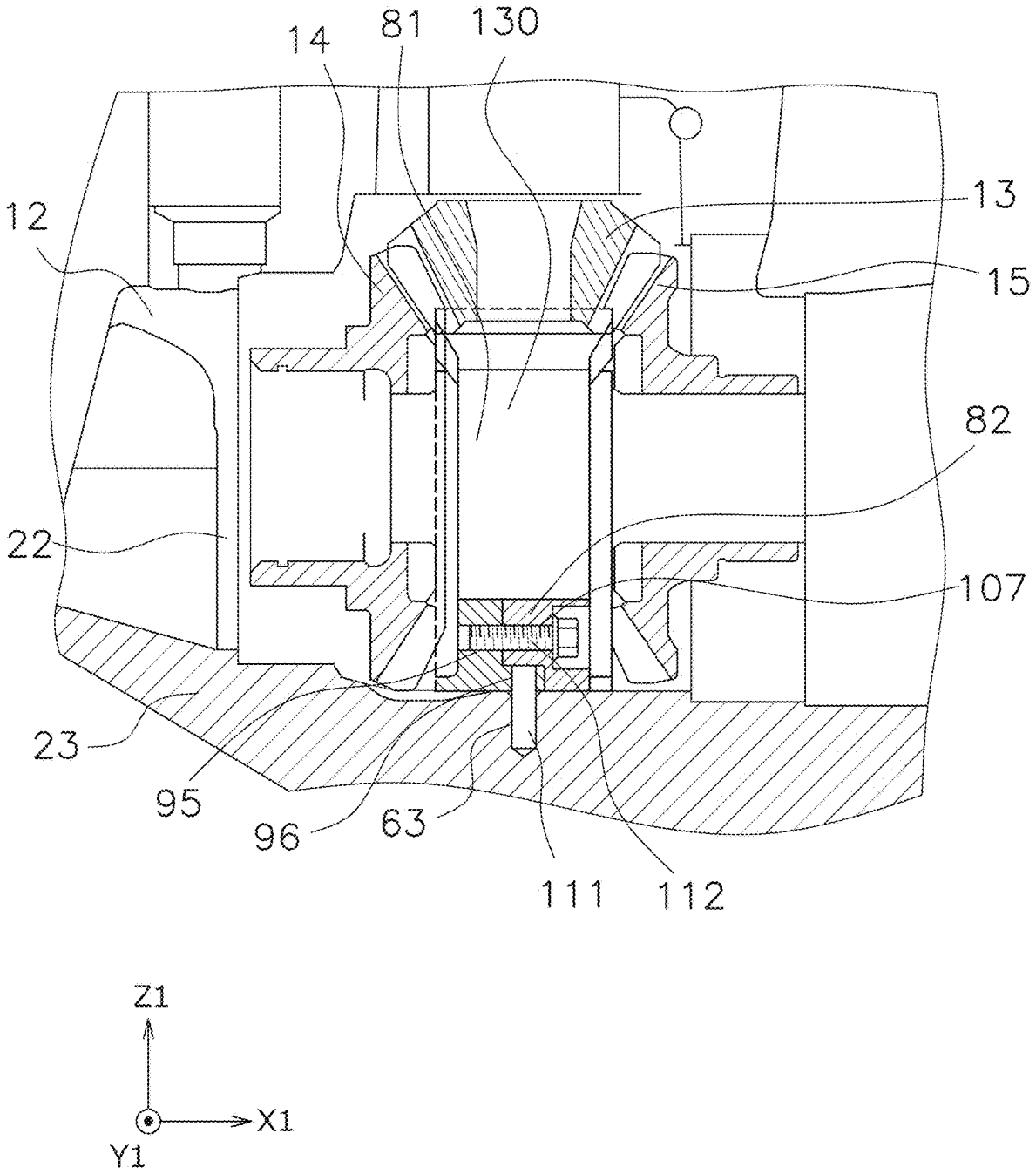
FIG. 9A is a cross-sectional view of an interior of a case of a marine propulsion device according to a second preferred embodiment of the present invention.
Figure 9B:
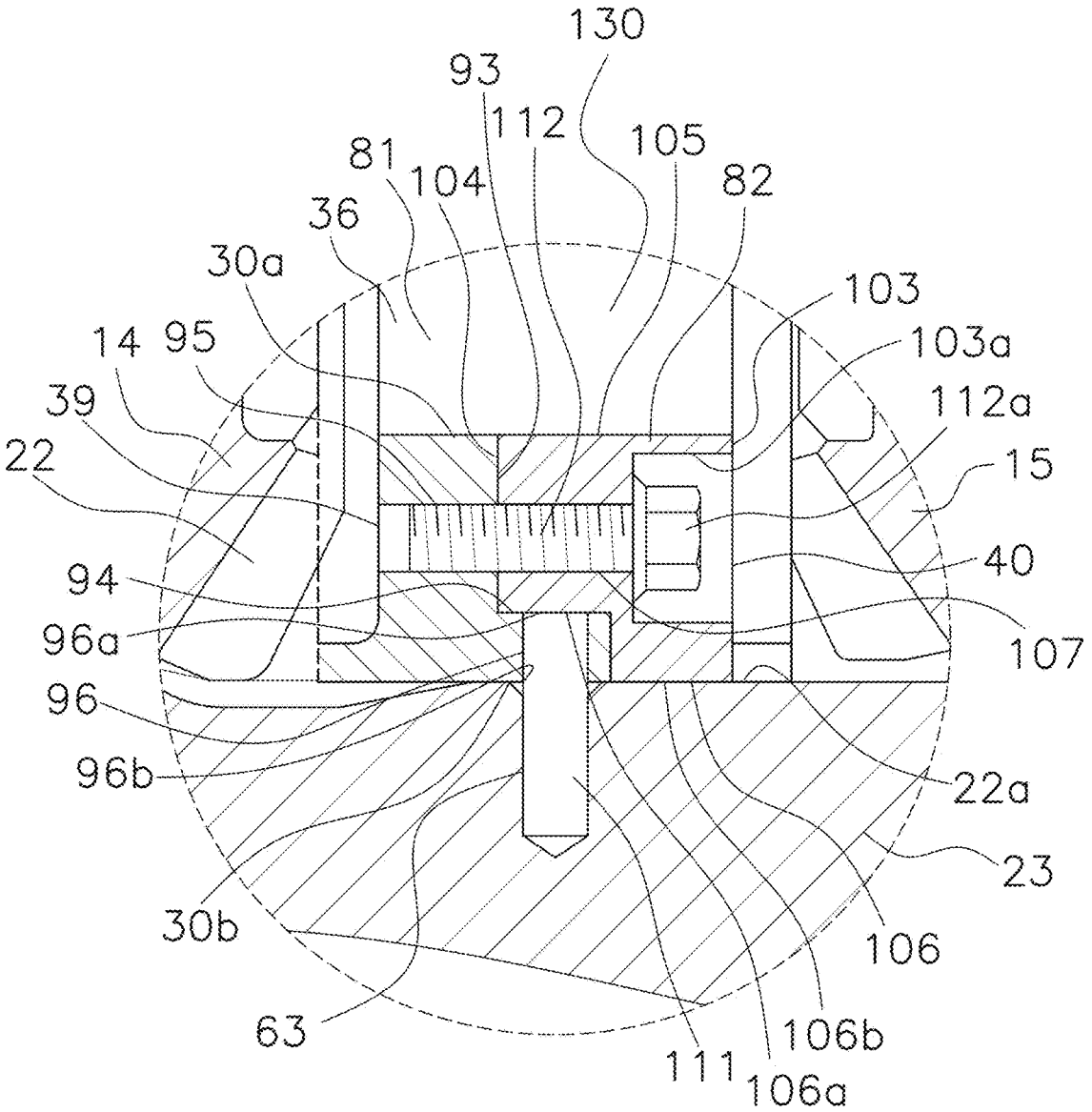
FIG. 9B is a partial enlarged view of FIG. 9A.
Figure 9B:
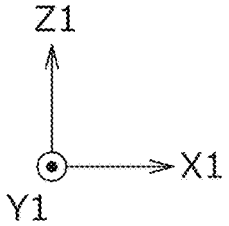
Figure 10:
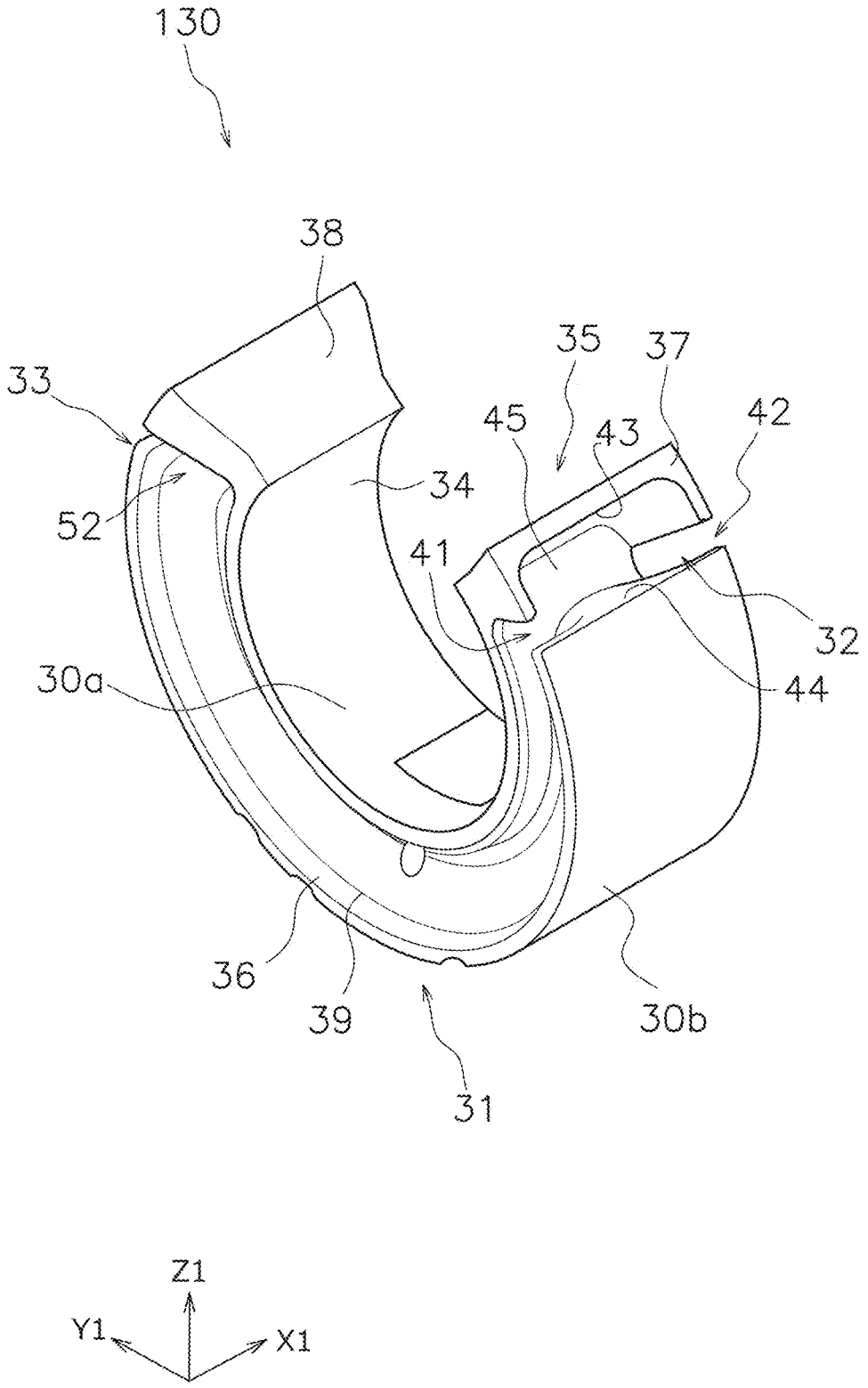
FIG. 10 is a perspective view of another circulator.
Figure 11:
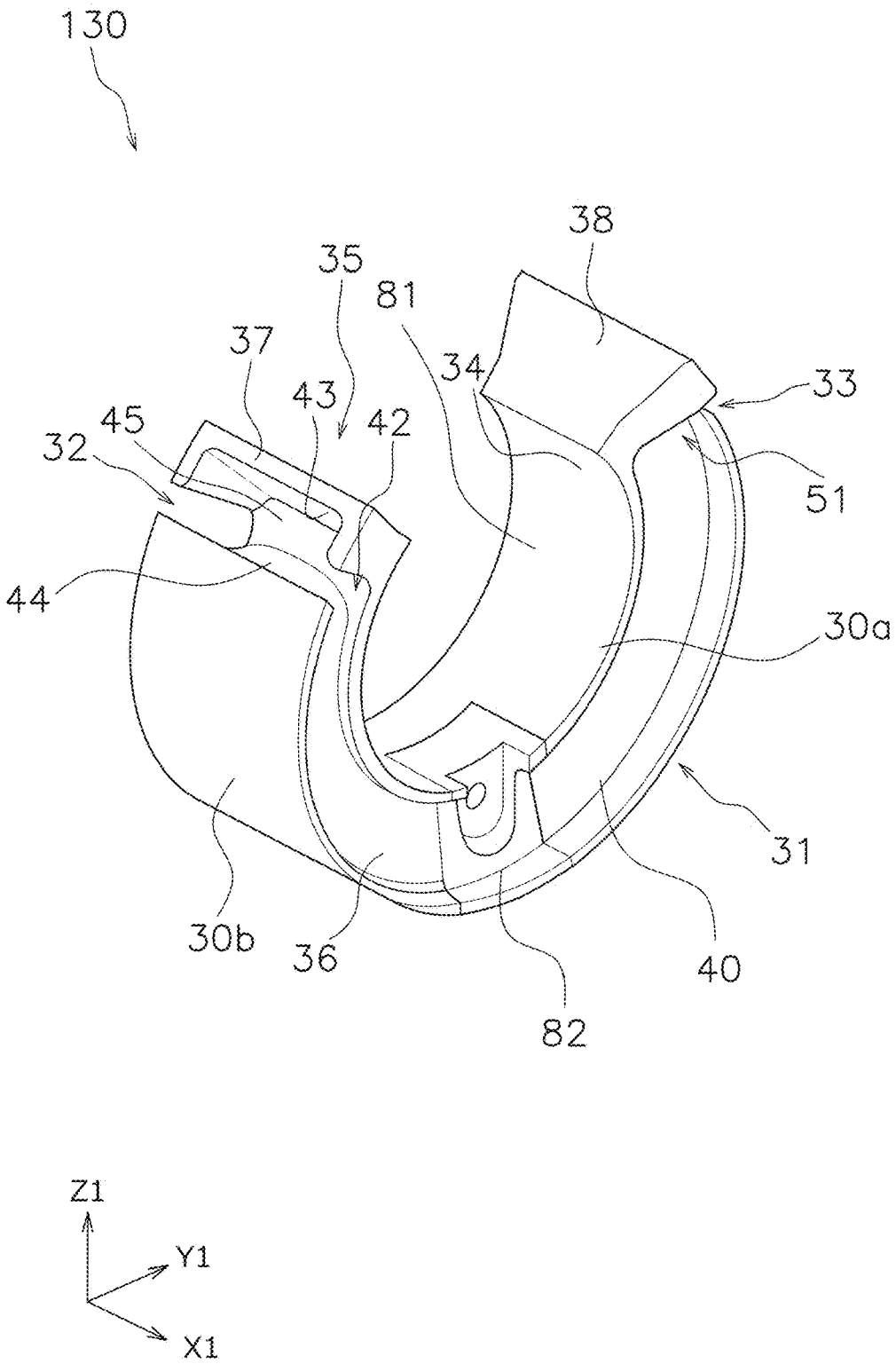
FIG. 11 is a perspective view of the circulator described above.

FIG. 9A is a cross-sectional view of the first gear 13, the second gear 14, the third gear 15, and a circulator 130 in the interior of the case 12. FIG. 9B is a partial enlarged view of FIG. 9A. FIGS. 10 and 11 are perspective views of the circulator 130 in according to the second preferred embodiment.

The circulator 130 according to the second preferred embodiment is substantially similar in contour to the circulator 30 in the first preferred embodiment but is different from the circulator 30 in that the circulator 130 includes two members. As shown in FIGS. 10 and 11, like the circulator 30, the circulator 130 includes the partition 31, the first channel 32, and the second channel 33. The partition 31 includes the middle hole 34, the opening 35, the first wall 36, the second wall 37, and the third wall 38. The first channel 32 includes the first inlet 41, the first outlet 42, the first top surface 43, the first bottom surface 44, and the first lateral surface 45. The second channel 33 in the second preferred embodiment includes the second inlet 51, the second outlet 52, the second top surface 53, the second bottom surface 54, and the second lateral surface 55, as in the first preferred embodiment (see FIG. 5A). In the second preferred embodiment, the second top surface 53, the second bottom surface 54, and the second lateral surface 55 are not shown in the drawings.

Figure 12:
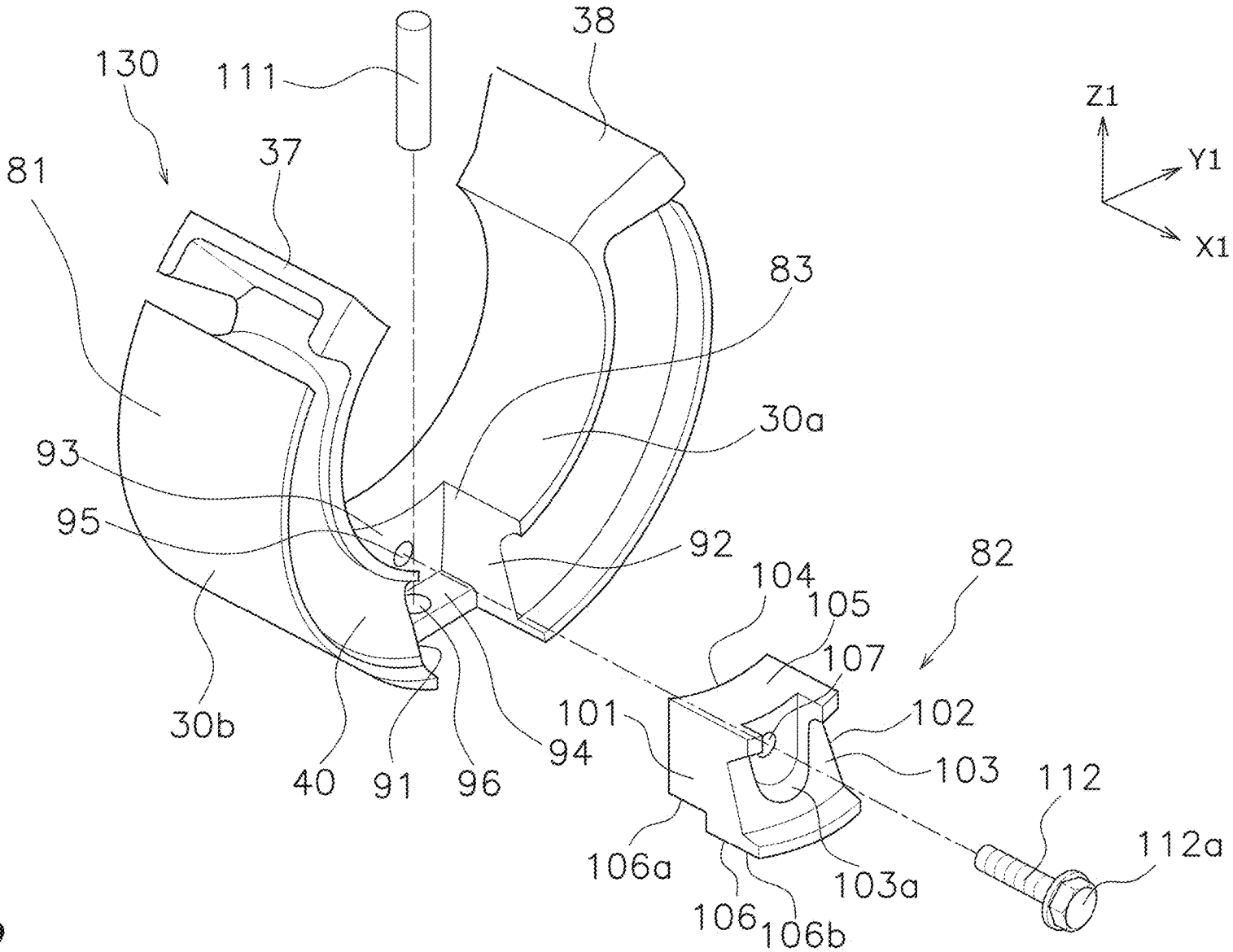
FIG. 12 is an exploded view of the circulator described above.

FIG. 12 is an exploded perspective view of the circulator 130. The circulator 130 includes a circulator body 81 and a restriction member 82.

The circulator body 81 includes a cutout portion 83 provided in a portion of the first wall 36. The restriction member 82 is fitted into the cutout portion 83. The cutout portion 83 is provided in the middle of the first wall 36 in the circumferential direction about the center line A1. The cutout portion 83 opposes the first shaft 3. The cutout portion 83 is formed by cutting out the inner peripheral surface 30*a*, the second recessed groove 40, and the outer peripheral surface 30*b*. It should be noted that as shown in FIG. 10, the first recessed groove 39 is provided on the circulator body 81 without being cut out. As shown in FIG. 12, the cutout portion 83 includes a first lateral surface 91, a second lateral surface 92, a third lateral surface 93, and a bottom surface 94.

The first and second lateral surfaces 91 and 92 include the inner lateral surfaces of the cutout portion 83 in the third axial direction Y1. The first and second lateral surfaces 91 and 92 are opposed to and parallel or substantially parallel to each other. The first and second lateral surfaces 91 and 92 are parallel or substantially parallel to each of the first axial direction Z1 and the second axial direction X1. The first lateral surface 91 is a side lateral surface of the second wall 37 in the cutout portion 83. The second lateral surface 92 is a side lateral surface of the third wall 38 in the cutout portion 83. The first and second lateral surfaces 91 and 92 from the second recessed groove 40 along the second axial direction X1. In the width of the circulator 30 along the second axial direction X1, the first and second lateral surfaces 91 and 92 extend from the second recessed groove 40 to an intermediate position so as not to reach the first recessed groove 39.

The third lateral surface 93 connects the first lateral surface 91 and the second lateral surface 92. The third lateral surface 93 is perpendicular or substantially perpendicular to the second axial direction X1. The circulator body 81 includes a fastening hole 95 extending from the third lateral surface 93 along the second axial direction X1. As shown in FIG. 9B, the fastening hole 95 penetrates through the first wall 36 from the third lateral surface 93 to the first recessed groove 39.

The bottom surface 94 is perpendicular or substantially perpendicular to the first axial direction Z1. The bottom surface 94 connects the first lateral surface 91, the second lateral surface 92, and the third lateral surface 93. The bottom surface 94 extends from the third lateral surface 93 along the second axial direction X1. The bottom surface 94 extends from the third lateral surface 93 toward the second recessed groove 40 without reaching the second recessed groove 40. The circulator body 81 includes a through hole 96 (an exemplary second through hole) extending from the bottom surface 94 to the outer peripheral surface 30*b* along the first axial direction Z1. As shown in FIG. 9B, the through hole 96 includes a first opening 96*b* in the outer peripheral surface 30*b*, and a second opening 96*a* in the bottom surface 94. The first opening 96*b* opposes the attachment hole 63. The second opening 96*a* is disposed on the opposite side of the first opening 96*b* in the through hole 96. A pin 111 (an exemplary attachment body) is inserted into the through hole 96, which will be described below.

The restriction member 82 is shaped to be fitted into the cutout portion 83. As shown in FIG. 12, the restriction member 82 includes a first lateral surface 101, a second lateral surface 102, a rear surface 103, a front surface 104, a top surface 105, and a bottom surface 106.

In completion of fitting the restriction member 82 to the cutout portion 83, the first lateral surface 101 opposes the first lateral surface 91 of the cutout portion 83. In completion of fitting the restriction member 82 to the cutout portion 83, the second lateral surface 102 opposes the second lateral surface 92 of the cutout portion 83. The first and second lateral surfaces 101 and 102 are parallel or substantially parallel to each other. The first and second lateral surfaces 101 and 102 are in alignment with each other in the third axial direction Y1. The first and second lateral surfaces 101 and 102 are parallel or substantially parallel to each of the first axial direction Z1 and the second axial direction X1.

In completion of fitting the restriction member 82 to the cutout portion 83, the rear surface 103 defines a portion of the second recessed groove 40. The rear surface 103 connects the rear end of the first lateral surface 101 and that of the second lateral surface 102. The rear surface 103 is provided with a recessed portion 103*a*. A fastening member, for example, a bolt 112, is fitted at a head 112*a* thereof to the recessed portion 103*a*, which will be described below.

The front surface 104 opposes the rear surface 103. The front surface 104 connects the front end of the first lateral surface 101 and that of the second lateral surface 102. In completion of fitting the restriction member 82 to the cutout portion 83, the front surface 104 opposes the third lateral surface 93.

In completion of fitting the restriction member 82 to the cutout portion 83, the top surface 105 defines a portion of the inner peripheral surface 30*a*. The top surface 105 connects the upper end of the first lateral surface 101, that of the second lateral surface 102, that of the rear surface 103, and that of the front surface 104.

In completion of fitting the restriction member 82 to the cutout portion 83, the bottom surface 106 defines a portion of the outer peripheral surface 30*b*. The bottom surface 106 opposes the top surface 105. The bottom surface 106 connects the lower end of the first lateral surface 101, that of the second lateral surface 102, that of the rear surface 103, and that of the front surface 104. The bottom surface 106 includes a first bottom surface portion 106*a* and a second bottom surface portion 106*b*. The first bottom surface portion 106*a* is a front side portion of the bottom surface 106. The second bottom surface portion 106*b* is a rear side portion of the bottom surface 106. As shown in FIG. 9B, in completion of fitting the restriction member 82 to the cutout portion 83, the first bottom surface portion 106*a* is disposed on the bottom surface 94 of the cutout portion 83. The second bottom surface portion 106*b* defines a portion of the outer peripheral surface 30*b* and is disposed on the inner surface 22*a*.

As shown in FIG. 9B, the restriction member 82 includes a through hole 107 (an exemplary third through hole) extending from the rear surface 103 to the front surface 104. The through hole 107 extends from the bottom surface of the recessed portion 103*a* of the rear surface 103 to the front surface 104. In completion of fitting the restriction member 82 to the cutout portion 83, the through hole 107 is disposed such that the center axis thereof corresponds to that of the fastening hole 95 of the circulator body 81. In completion of fitting the restriction member 82 to the cutout portion 83 of the circulator body 81, the bolt 112 is inserted into the fastening hole 95 through the through hole 107. The bolt 112 is provided with male threads on the distal end thereof, which are screwed into female threads provided in the fastening hole 95. The head 112*a* of the bolt 112 is fitted into the recessed portion 103*a* of the rear surface 103.

As shown in FIG. 9B, the pin 111 is inserted into the attachment hole 63 through the through hole 96 of the circulator body 81. The pin 111 is greater in length than the attachment hole 63 and thus reaches the through hole 96. The length of the pin 111 is less than or equal to the sum of the length of the attachment hole 63 and the length of the through hole 96. Thus, the length of the pin 111 is set such that the pin 111 does not protrude from the second opening 96*a* of the through hole 96. In the second preferred embodiment, the attachment hole 63 is not provided with female threads.

In completion of fitting the restriction member 82 to the cutout portion 83 of the circulator body 81, the second bottom surface portion 106*b* of the restriction member 82 is disposed on the inner surface 22*a*, while the first bottom surface portion 106*a* is disposed on the bottom surface 94 of the cutout portion 83. In this manner, the second opening 96*a* of the through hole 96 is closed by the restriction member 82 such that the pin 111 is restricted from moving toward the internal space S0.

Figure 13:
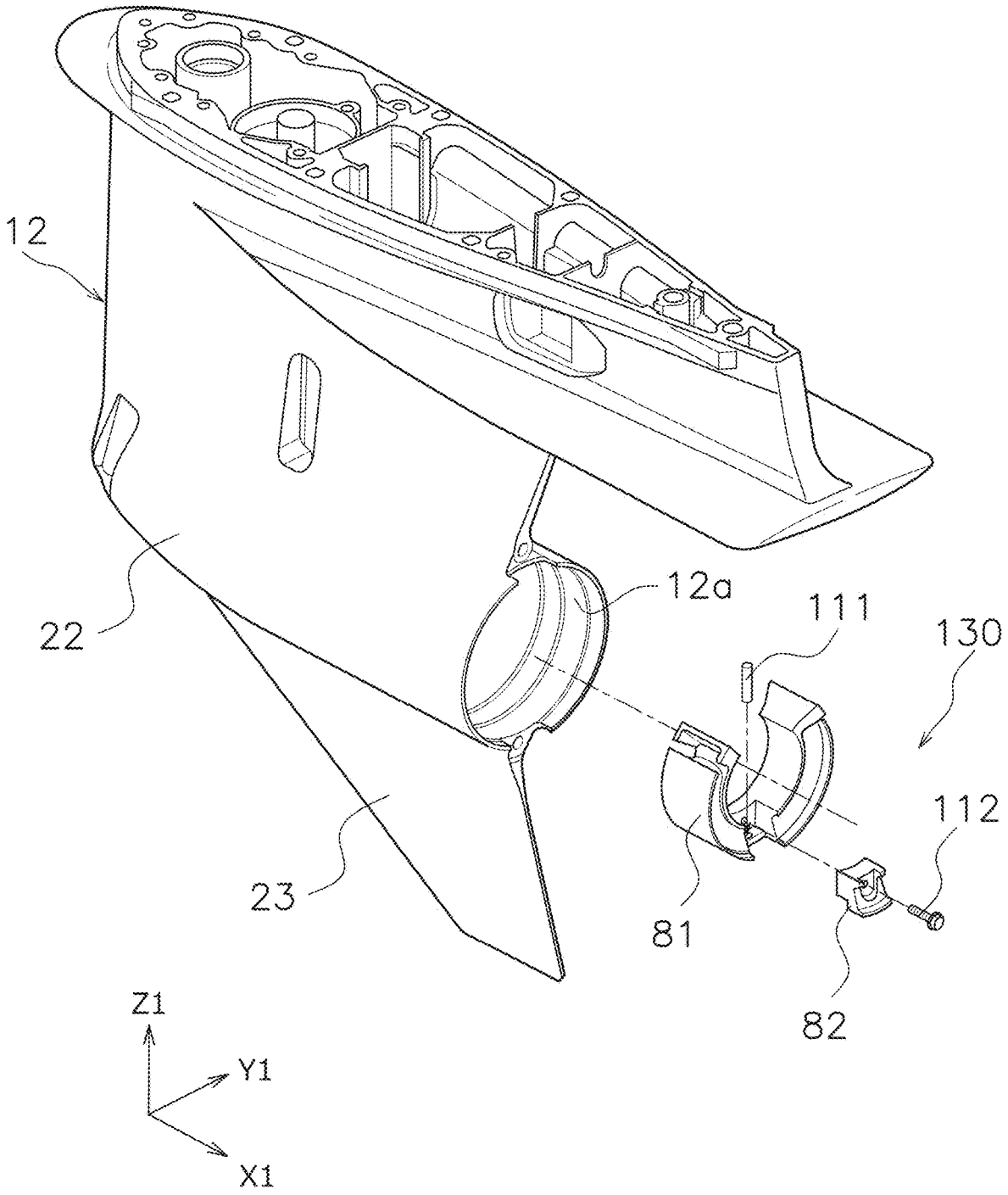
FIG. 13 is a perspective view showing a method of attaching the circulator described above to the case.
Figure 14:
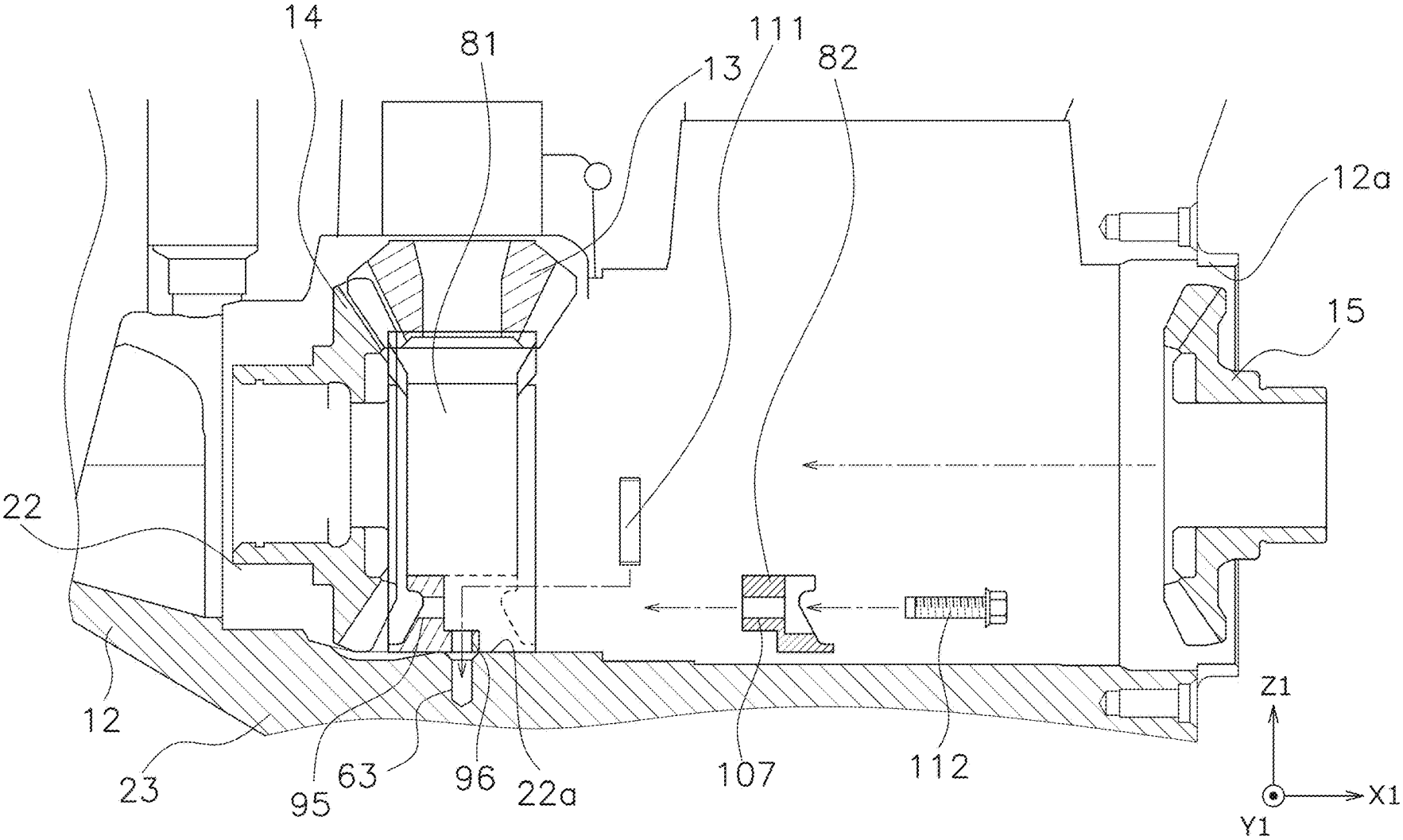
FIG. 14 is a cross-sectional side view showing the method of attaching the circulator described above to the case.

Next, a method of attaching the circulator 130 to the case 12 will be explained. FIG. 13 is an external view explaining the method of attaching the circulator 130 to the case 12. FIG. 14 is a side view explaining the method of attaching the circulator 130 to the case 12.

As shown in FIG. 13, the circulator body 81 is inserted into the case 12 along the second axial direction X1 through the opening 12*a* provided on the propeller 7 side of the case 12. As shown in FIG. 14, when the circulator body 81 is inserted into the case 12, the first gear 13 and the second gear 14 are placed in advance in the gear case 22 of the case 12. In this condition, the circulator body 81 is slid along the second axial direction X1 so as to be inserted into the case 12 through the opening 12*a*. The circulator body 81 is disposed on the inner surface 22*a* such that the through hole 96 thereof opposes the attachment hole 63.

Next, the pin 111 is inserted into the attachment hole 63 in the case 12 through the through hole 96 of the circulator body 81.

Next, the restriction member 82 is slid along the second axial direction X1 so as to be inserted into the case 12 through the opening 12*a*, then the restriction member 82 is fitted into the cutout portion 83 of the circulator body 81.

Next, the bolt 112 is inserted into the fastening hole 95 through the through hole 107. The bolt 112 is inserted into the case 12 from the opening 12*a* side. A tool, such as a screwdriver, can be also inserted into the case 12 through the opening 12*a* such that the bolt 112 can be tightened by the tool.

Next, the clutch mechanism 16 and the third gear 15 are inserted into the case 12, then the second shaft 4 is inserted into the case 12 so as to be inserted into the second and third gears 14 and 15.

With the method described above, the circulator 130 can be fixed to the gear case 22. Thus, not only insertion of the circulator 130 but also fixation of the circulator 130 is enabled through the opening 12*a* provided on the propeller 7 side of the case 12. Thus, the circulator 130 is easily fixed to the case 12.

In the marine propulsion device 1 according to the second preferred embodiment explained above, the bolt 112 can be tightened from the propeller 7 side. Because of this, the tool is easily accessible to the bolt 112, and visibility is enhanced when checking the assembled components. Even when a clip or so forth is required to retain the bolt 112, attachment of the clip or so forth is easy. Fixation by the pin 111 is only used to fix the circulator body 81 to the case 12. Thus, the circulator body 81 is easily set in place with respect to the case 12. Since the circulator 130 is fastened to the case 12 by the bolt 112, it is possible to enhance both the assembly and the disassembly of the circulator 130 with respect to the case 12.

Preferred embodiments of the present invention have been explained above. However, the present invention is not limited to the preferred embodiments described above, and a variety of changes can be made without departing from the gist of the present invention.

In the first preferred embodiment described above, the collar 72 is disposed outside the bolt 71; alternatively, only the bolt 71 may be inserted into the through hole 60 without including the collar 72. Instead of the collar 72, a washer may be disposed between the head 71*a* of the bolt 71 and the circulator 30.

In the second preferred embodiment described above, the bolt 112 is directly inserted into the through hole 107; alternatively, a collar or washer may be disposed between the bolt 112 and the circulator 130.

The bolt 71 is used in the first preferred embodiment described above; on the other hand, the bolt 112 is used in the second preferred embodiment described above. However, a screw may be used instead of the bolt in each preferred embodiment. Thus, the fastening member is not limited to a particular type as long as the components are able to be fastened together.

Figure 15:
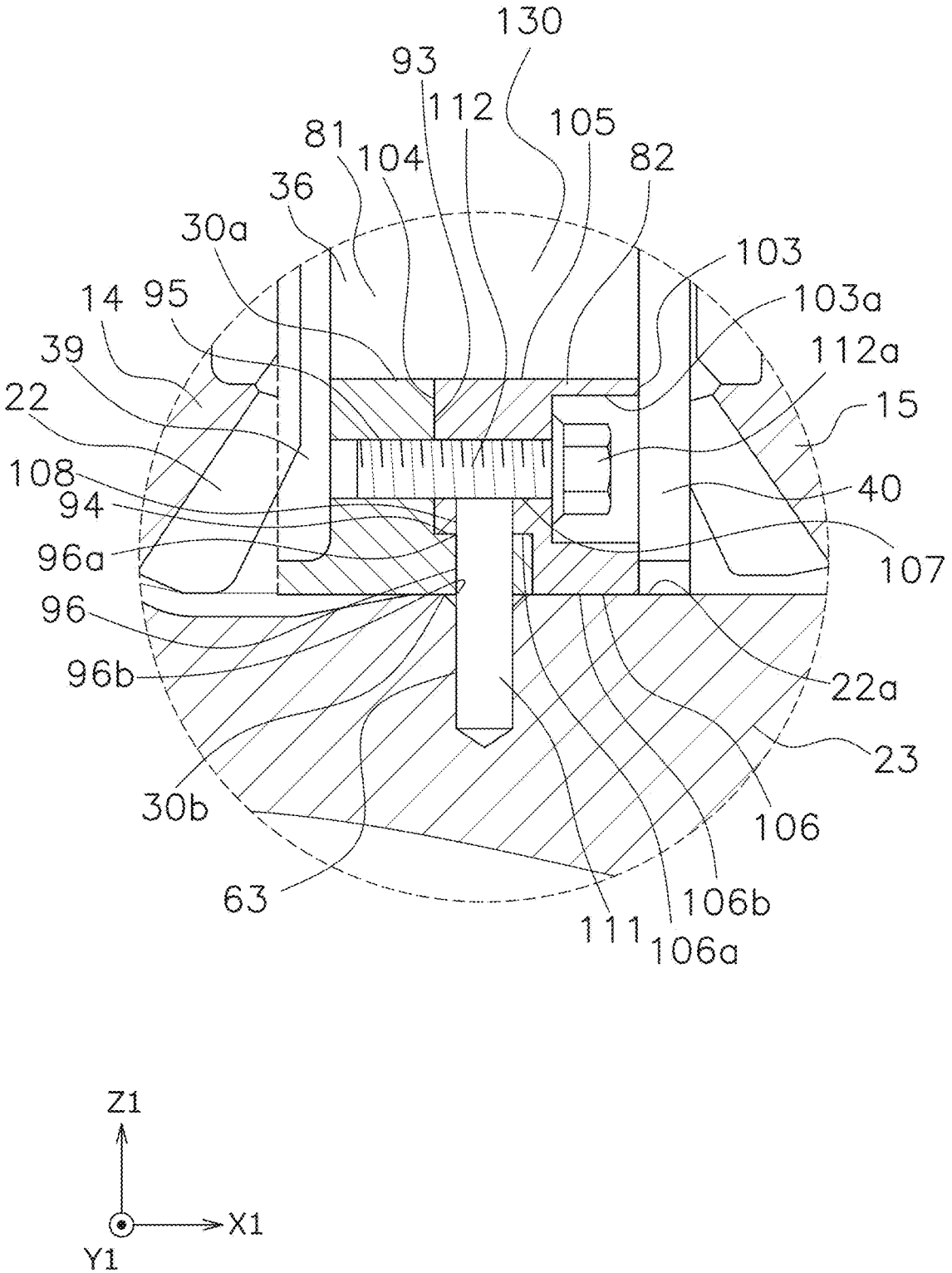
FIG. 15 is a cross-sectional view explaining yet another circulator according to a modification of the second preferred embodiment of the present invention.

In the second preferred embodiment described above, movement of the pin 111 is restricted by the first bottom surface portion 106*a* of the restriction member 82; however, the configuration to restrict the movement of the pin 111 is not limited to this. For example, the movement of the pin 111 may be restricted by the bolt 112. FIG. 15 is a cross-sectional view of the configuration to restrict movement of the pin 111 by the bolt 112. In the configuration shown in FIG. 15, the restriction member 82 is provided with a through hole 108 extending from the first bottom surface portion 106*a* to the through hole 107. The pin 111 is disposed throughout the attachment hole 63, the through hole 96, and the through hole 108. The pin 111 is restricted from moving upward by the bolt 112 inserted into the through hole 107.

The type of device used as the marine propulsion device 1 is not limited to the outboard motor and may be changed. For example, the marine propulsion device 1 may be an inboard engine outboard drive or a jet propulsion device. The shape of each circulator 30, 130 is not limited to that in the preferred embodiments described above and may be changed. For example, the second and third walls 37 and 38 may be omitted. In this case, a space between the first gear 13 and one circumferential end of the first wall 36 may be used as the first channel 32. On the other hand, a space between the first gear 13 and the other circumferential end of the first wall 36 may be used as the second channel 33.

The shape of the partition 31 is not limited to that in the preferred embodiments described above and may be changed. For example, the first and second recessed grooves 39 and 40 may be omitted. The shape of the first channel 32 and that of the second channel 33 are not limited to those in the preferred embodiments described above and may be changed. For example, each of the first and second top surfaces 43 and 53 may have a flat shape. Each of the first and second bottom surfaces 44 and 54 may have a flat shape.

Either or both of the first and second channels 32 and 33 may be omitted. Even in this case, a collision of lubricating oil is reduced or prevented due to the flow of the lubricating oil caused by the rotation of the second gear 14 and that caused by the rotation of the third gear 15. Accordingly, the loss of a drive torque is reduced or prevented. In other words, the efficiency of transmitting the drive torque is enhanced.

According to preferred embodiments of the present invention, it is possible to provide improved configurations to fix a circulator to a case in a marine propulsion device.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

a first gear;

a second gear meshed with the first gear;

a third gear meshed with the first gear, the third gear being coaxial to the second gear and opposed to the second gear;

a circulator between the second gear and the third gear;

a case including an internal space in which the first gear, the second gear, the third gear, and the circulator are located, the case including an attachment hole to which the circulator is attached; and an attachment body inserted into the attachment hole to attach the circulator to the case; wherein the attachment hole includes female threads on an inner peripheral surface thereof;

the attachment body includes male threads at least on a distal end thereof;

the attachment body is inserted into the attachment hole and through the circulator; and the male threads of the attachment body are screwed into the female threads of the attachment hole.

2. The marine propulsion device according to claim 1, wherein the case includes:

a gear case including the internal space; and a skeg extending downward from the gear case; and the attachment hole extends from the gear case to the skeg.

3. The marine propulsion device according to claim 1, further comprising:

a drive source;

a first shaft connected to the drive source and extending in a first axial direction;

a second shaft extending in a second axial direction intersecting with the first axial direction; and a clutch; wherein the first gear is connected to the first shaft;

the second gear is coaxial with the second shaft and rotatable with respect to the second shaft;

the third gear is coaxial with the second shaft, the third gear being rotatable with respect to the second shaft and opposed to the second gear in the second axial direction;

the clutch is operable to switch between engagement and disengagement of the second gear and the second shaft and between engagement and disengagement of the third gear and the second shaft; and the attachment hole is below the second shaft and extends parallel or substantially parallel to the first axial direction.

4. The marine propulsion device according to claim 1, further comprising:

a drive source;

a first shaft connected to the drive source and extending in a first axial direction;

a second shaft extending in a second axial direction intersecting with the first axial direction; and a clutch; wherein the first gear is connected to the first shaft;

the second gear is coaxial with the second shaft and rotatable with respect to the second shaft;

the third gear is coaxial with the second shaft, rotatable with respect to the second shaft, and opposed to the second gear in the second axial direction;

the clutch is operable to switch between engagement and disengagement of the second gear and the second shaft and between engagement and disengagement of the third gear and the second shaft;

the circulator includes:

a middle hole extending in the second axial direction through which the second shaft extends;

an opening in which the first gear is located and extending radially outward from the middle hole;

an inner peripheral surface defining the middle hole and having a circular-arc shape as seen along the second axial direction;

an outer peripheral surface disposed radially outside the inner peripheral surface and having a circular-arc shape as seen along the second axial direction; and a first through hole extending through the circulator from the inner peripheral surface to the outer peripheral surface; and the attachment body is inserted into the attachment hole through the first through hole.

5. A marine propulsion device comprising:

a first gear;

a second gear meshed with the first gear;

a third gear meshed with the first gear, the third gear being coaxial to the second gear and opposed to the second gear;

a circulator between the second gear and the third gear;

a case including an internal space in which the first gear, the second gear, the third gear, and the circulator are located, the case including an attachment hole to which the circulator is attached; and an attachment body inserted into the attachment hole to attach the circulator to the case; wherein a circulator body including a second through hole in which the attachment body is disposed, the second through hole including a first opening and a second opening, the first opening opposed to the attachment hole, and the second opening provided on an opposite side of the first opening;

a restrictor fastened to the circulator body so as to close the second opening of the second through hole, the restrictor operable to restrict the attachment body in the attachment hole and the second through hole from moving out of the second opening; and a fastener to fasten the restriction member to the circulator body.

6. The marine propulsion device according to claim 5, further comprising:

a drive source;

a first shaft connected to the drive source and extending in a first axial direction;

a second shaft extending in a second axial direction that intersects with the first axial direction;

a propeller attached to the second shaft; and a clutch; wherein the first gear is connected to the first shaft, the second gear is coaxial with the second shaft and rotatable with respect to the second shaft;

the third gear is coaxial with the second shaft, rotatable with respect to the second shaft, and opposed to the second gear in the second axial direction;

the clutch operable to switch between engagement and disengagement of the second gear and the second shaft and between engagement and disengagement of the third gear and the second shaft;

the circulator body includes a fastening hole extending along the second axial direction;

the restrictor includes a third through hole extending along the second axial direction, the third through hole disposed on a propeller side of the fastening hole; and the fastener is inserted into the third through hole and the fastening hole from the propeller side.

7. The marine propulsion device according to claim 1, wherein the circulator is made of metal.

* * * * *